United States Patent [19]

Hester, II

[11] Patent Number: 4,527,515

[45] Date of Patent: Jul. 9, 1985

[54] STEAM GENERATOR CLEANING APPARATUS CONTROL SYSTEM

[75] Inventor: Lawrence R. Hester, II, Duncan, Okla.

[73] Assignee: Halliburton Company, Duncan, Okla.

[21] Appl. No.: 704,881

[22] Filed: Feb. 21, 1985

Related U.S. Application Data

[63] Continuation of Ser. No. 483,807, Apr. 11, 1983, abandoned.

[51] Int. Cl.[3] ..... F22B 37/52

[52] U.S. Cl. ..... 122/392; 15/316 A; 15/404; 122/382; 122/402; 122/405; 134/168 C; 165/95

[58] Field of Search ..... 122/379, 380, 382, 384, 122/388, 390, 392, 396, 398, 399, 402, 405, 429; 165/95; 15/316 R, 316 A, 318 A, 404; 134/167 R, 168 R, 169 R, 172, 178, 179, 188; 239/127, 178, 195, 246, 548

[56] References Cited

U.S. PATENT DOCUMENTS

| | | | |
|---|---|---|---|
| 2,565,689 | 8/1951 | Howse | 122/379 |
| 2,597,597 | 5/1952 | Rice | 122/382 |
| 2,722,032 | 11/1955 | DeMart | 15/316 A |
| 2,902,707 | 9/1959 | Bearer, Jr. | 15/316 A |
| 3,396,706 | 8/1968 | Rayburn | 122/379 |
| 3,541,999 | 11/1970 | Winkin | 122/392 |
| 3,661,124 | 5/1972 | Winkin | 122/392 |
| 3,701,341 | 10/1972 | Willis, Jr. | 122/392 |
| 3,910,497 | 10/1975 | Manor | 239/127 |
| 4,079,701 | 3/1978 | Hickman et al. | 122/382 |
| 4,273,076 | 6/1981 | Lahoda et al. | 122/382 |
| 4,276,856 | 7/1981 | Dent et al. | 122/382 |
| 4,354,294 | 10/1982 | Silver | 122/392 |
| 4,503,811 | 3/1985 | Hammond | 122/392 |

*Primary Examiner*—Edward G. Favors
*Assistant Examiner*—Steven E. Warner
*Attorney, Agent, or Firm*—E. Harrison Gilbert, III; James R. Duzan; Thomas R. Weaver

[57] ABSTRACT

A control system for controlling a cleaning apparatus used for cleaning a steam generator includes a valve manifold which is controlled by a control console to direct a pressurized fluid to either a jetting outlet or a flushing outlet of the cleaning apparatus associated with the steam generator. The control console also controls a motor controller which defines the incremental distance that the jetting outlet is moved within the steam generator to clean different portions of the steam generator. The motor controller is remotely controllable from a platform control device so that the position of the jetting outlet can be changed by a person located on or near the steam generator during initial alignment and limit switch positioning. The control console also controls an evacuation circuit which extracts the fluid pumped into the steam generator and the sludge or other substances loosened therefrom. The control console still further controls the suction valves of a pump which provides the pressurized fluid so that the pressure can be extinguished upon either manual command or an automatically detected condition of the valves in the valve manifold. The pressure from the pump can also be extinguished by a remote controller functioning through the control console.

9 Claims, 17 Drawing Figures

STEAM GENERATOR CLEANING APPARATUS CONTROL SYSTEM

This application is a continuation of application Ser. No. 483,807, filed Apr. 11, 1983, now abandoned.

The present invention relates to a control system for controlling an apparatus used to clean a steam generator and more particularly, but not by way of limitation, to a control system for controlling the advancement of a sludge lance and the application of a pressurized fluid into a nuclear steam generator.

Nuclear power plants typically utilize a steam generator having a vertical, inverted U-shaped tube bundle which carries the primary water directly heated by the nuclear reaction. Feedwater is carried by the shell side of the generator in contact with the tube bundle for generating steam to be directed to steam turbines.

Among the maintenance problems that can arise in such nuclear power plants, some of the most potentially troublesome include sludge build-up in the steam generator, and particularly relate to concentrations of sludge which may accumulate on the tube sheet at the lower end of the tube bundle.

This accumulation of sludge lowers steam production capacity, and the particles in the feedwater can cause abrasion of the U-tubes in the upper portions of the steam generator. These solids may even cause the steam turbine to foul if they are carried over in the steam. Also, since water chemistry cannot be controlled within the sludge piles, the steam generator tubes may corrode or dent.

Several problems are caused by damaged tubes. Primary water from the tube bundle may leak into the feedwater that is to be turned into steam, thus creating a safety hazard. Plugged and sleeved tubes reduce the heat transfer area of the steam generator. As more time is required to be allotted to maintenance, more radiation exposure is required for maintenance personnel. Also, the steam generator's productive life span can be decreased significantly.

Previous systems for high pressure water lancing of the spaces between the tube rows of the tube bundle of the steam generator have usually required the continuous presence of an operator at the steam generator hand holes.

To remove the sludge from the steam generator, there is the need for a cleaning apparatus which can be used to remove the sludge from the steam generator and a control system for properly operating the cleaning apparatus to effect the cleansing of the steam generator. A suitable cleaning apparatus is disclosed in a copending U.S. patent application entitled "Sludge Lance Advancing Apparatus" which is assigned to the assignee of the present invention. A control system for controlling such a cleaning apparatus is provided by the present invention.

A suitable control system for controlling the cleaning apparatus preferably can be operated in an automatic mode whereby the cleaning apparatus is moved and flowed to effect cleansing of the steam generator with a minimum of operator involvement. Although such a control system should be operable in an automatic mode, it should be capable of being operated in a manual mode in the event direct human control is necessary.

The operator of such a control system should be able to remotely control the positioning of the cleaning apparatus to assist in properly setting up and aligning the cleaning apparatus in relationship to the steam generator. Remote control of fluid pressurization of the cleaning fluid should also be included in the control system so that the fluid can be depressurized in the case of an emergency. The control system should also include automatic controls for depressurizing the fluid in response to certain automatically detected conditions in the system.

Such a control system should also be able to sense when the cleaning apparatus has moved to a predetermined limit so that further movement and fluid application are prevented. The system should also be able to control the direction of movement of the cleaning apparatus within the steam generator.

So that the cleaning fluid and loosened sludge can be extracted from the steam generator, the control system should also include means for operating a suction pump associated with an outlet of the steam generator.

The novel and improved control system provided by the present invention satisfies the aforementioned needs in providing suitable control of a cleaning apparatus, such as the cleaning apparatus disclosed in the copending U.S. patent application entitled "Sludge Lance Advancing Apparatus" and assigned to the assignee of the present invention.

The control system of the present invention provides for either automatic or manual control of the cleaning apparatus. This automatic or manual control effects proper movement of the cleaning apparatus and the application of cleaning fluid into the steam generator. The system includes remote control means for manually indexing the positioning of the cleaning apparatus and remote control means for controlling the pressurization of the cleaning fluid. Fluid pressurization control is also automatically maintained in response to detected positions of valves of the control system of the present invention.

The control system of the present invention also includes means for controlling the direction of movement of the cleaning apparatus in the steam generator and means for sensing the limits of travel of the cleaning apparatus. The control system also includes means for controlling a suction pump which extracts the cleaning fluid and loosened sludge from the steam generator.

Broadly, the present invention provides a system for controlling an apparatus for cleaning a steam generator, which apparatus includes an advance mechanism for moving a jetting outlet within the steam generator and which apparatus also includes a flushing outlet and fluid source means for providing a fluid under pressure to either the jetting outlet or the flushing outlet. The system comprises valve manifold means for communicating the fluid from the fluid source means with a selectable one of the jetting outlet or the flushing outlet, advance mechanism control means for controlling the distance the advance mechanism moves the jetting outlet, and control means for controlling the valve manifold means and the advance mechanism control means. The control means includes timing means for providing a first signal to the valve manifold means to cause the valve manifold means to communicate the fluid with the jetting outlet and for providing a second signal to the valve manifold means and the advance mechanism control means to cause the valve manifold means to communicate the fluid with the flushing outletand to activate the advance mechanism control means to move the advance mechanism. The control means also includes monitor means for monitoring the state of the valve manifold means, and the control means further includes fluid source control means for causing the fluid source means to relieve the pressure on the fluid in response to the monitor means.

The system also comprises limit means, associated with the advance mechanism, for providing a limit signa when the advance mechanism reaches a predetermined travel extremity. The advance mechanism control means includes means for providing a timing means control signal in response to the limit signal provided by the limit means. The control means includes means for preventing the timing means from providing the first and second signals in response to the timing means control signal.

The system of the present invention also broadly comprises means for controlling the fluid source controlmeans from a location spaced from the control means and without regard to the state of the valve manifold means. The systemalso includes manual means for manually controlling the advance mechanism control means from a location spaced from the control means.

Therefore, from the foregoing, it is a general object of the present invention to provide a novel and improved control system for a cleaning apparatus for cleaning a steam generator. Other and further objects, features and advantages of the present invention will be readily apparent to those skilled in the art when the following description of the preferred embodiment is read in conjunction with the accompanying drawings.

FIG. 6 is a front elevational view of the control console of the preferred embodiment of the present invention.

FIG. 8 is a schematic circuit diagram of the motor controller means of the preferred embodiment of the present invention.

FIG. 9A is an exterior view of the platform control box of the preferred embodiment of the present invention.

Figure 1:
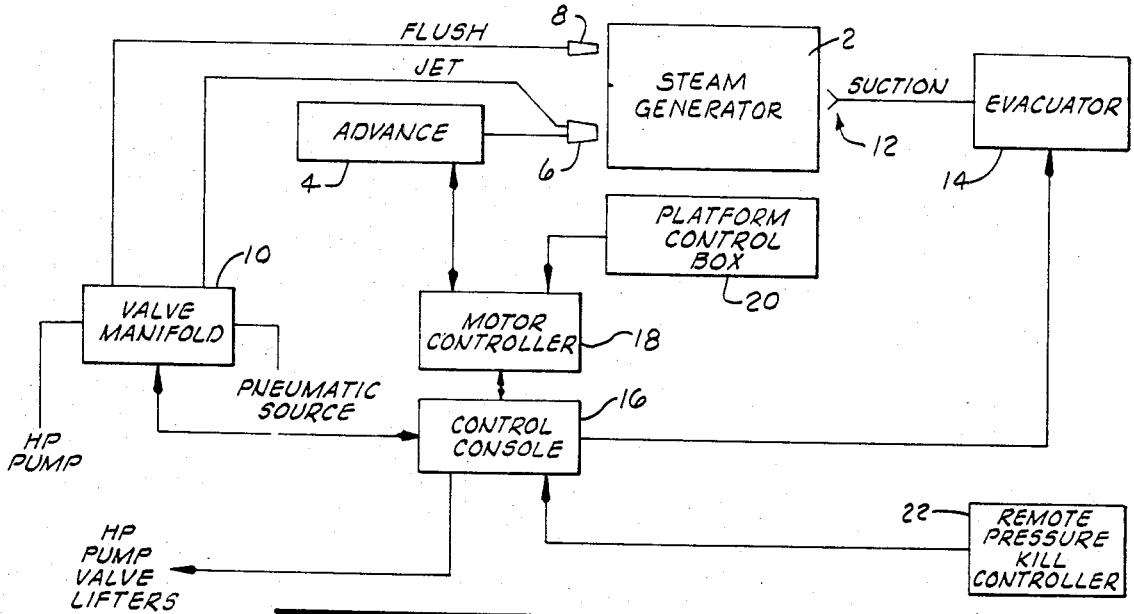
FIG. 1 is a functional block diagram of the control system of the present invention.

With reference to the drawings, a control system constructed in accordance with the preferred embodiment of the present invention will be described. In FIG. 1, the control system of the present invention is shown associated with a steam generator 2 and a cleaning apparatus used for cleaning the steam generator 2. The cleaning apparatus includes an advance mechanism 4 for moving a jetting outlet 6 into and out of the steam generator 2. The cleaning apparatus also includes a flushing outlet 8. The cleaning apparatus still further includes fluid source means, shown in FIG. 1 as a high pressure (HP) pump, for providing a fluid under pressure to either the jetting outlet 6 or the flushing outlet 8. This pressurized fluid is provided to either the jetting outlet 6 or the flushing outlet 8 via a valve manifold means 10 forming a part of the control system of the present invention.

The cleaning apparatus with which the present invention is associated also includes a suction inlet 12 from the steam generator 2. The suction inlet 12 is connected to an evacuation skid 14.

The valve manifold means 10 and the evacuation skid 14 are controlled in response to control signals from a control console 16 forming another part of the control system of the present invention. The control console 16 also provides control signals to a motor controller means 18 forming another part of the control system of the present invention.

The motor controller means 18 directly controls the movement of the advance mechanism 4 and directly responds to a signal from the advance mechanism 4 indicating a limit of travel has been reached by the advance mechanism 4. The motor controller means 18 is manually controllable in response to signals from a platform control box 20 forming another part of the control system of the present invention.

The control console 16 is responsive to limit signals from the motor controller means 18 and to pressure kill signals from one or more remote pressure kill controller means 22 which forms still another part of the control system of the present invention. When a pressure kill signal is generated within the control console 16, it is provided to the high pressure pump of the cleaning apparatus to lift the suction valves of the pump, thereby depressurizing the fluid provided by the high pressure pump to the valve manifold means 10.

Figure 2:
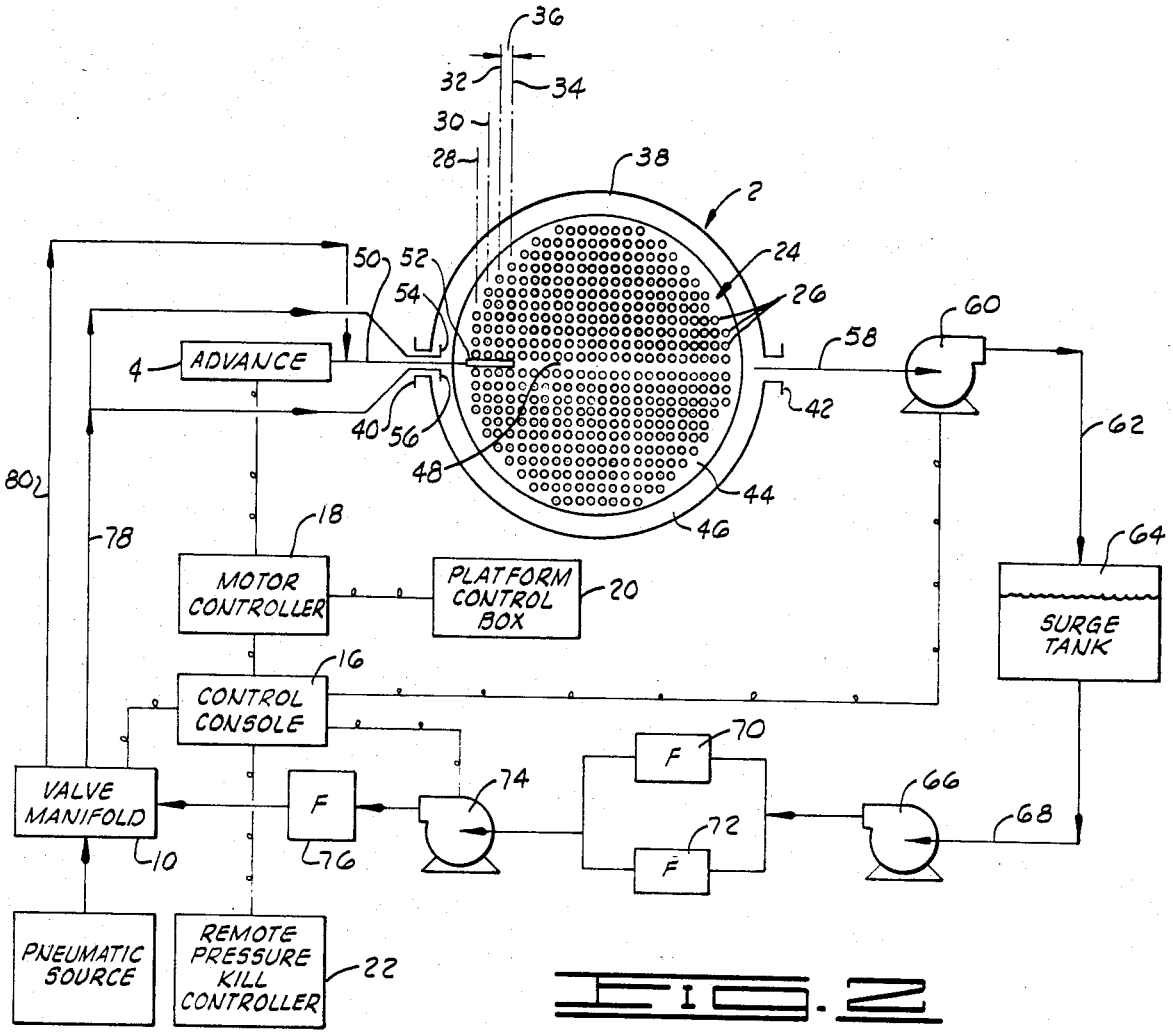
FIG. 2 is a functional block and schematic diagram showing the control system of the present invention in association with a more particularly described cleaning apparatus.
Figure 3:
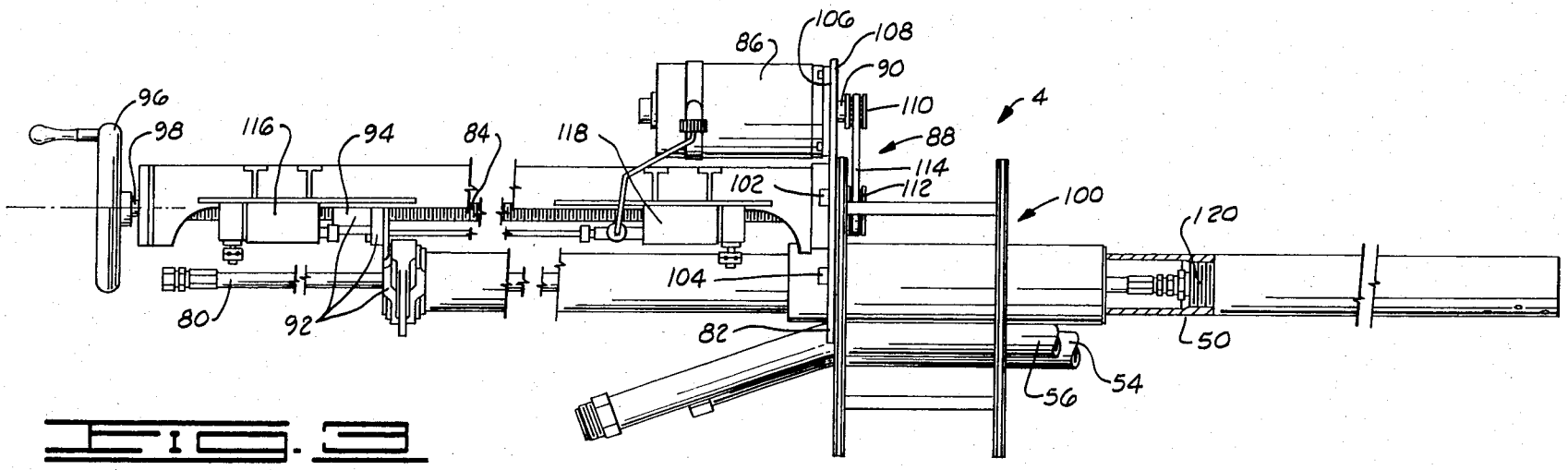
FIG. 3 is a side elevational view of a particular advancing apparatus and sludge lance with which the control system of the present invention can be used.

With reference to FIGS. 2 and 3, a particular embodiment of the cleaning apparatus with which the present invention is contemplated to be used will be disclosed. This cleaning apparatus, including the particular embodiment of the advance mechanism shown in FIG. 3, is particularly described in the copending U.S. patent application entitled "Sludge Lance Advancing Apparatus" and assigned to the assignee of the present invention.

In FIG. 2, the steam generator 2 is of a type used in a nuclear reactor as known to the art. The steam generator 2 includes an inverted U-shaped tube bundle shown generally in cross-section and designated by the numeral 24 in FIG. 2. The tube bundle 24 includes a plurality of tubes, such as designated, for example, by the numeral 26, which are arranged in a plurality of parallel, equally spaced rows.

In the following disclosure, for the purpose of illustration only, the rows of tubes 26 are designated as being the rows which are parallel to the length of the drawing sheet such as indicated by phantom lines 28, 30, 32 and 34. These rows are equally spaced by a distance such as indicated by distance 36 between rows 32 and 34.

The steam generator 2 includes an outer shell 38 having a pair of flanged hand holes 40 and 42 at diametrically opposite sides thereof. The lower ends of the tubes 26 extend through a tube sheet 44. An annular space 46 is defined between tube bundle 24 and shell 38. The hand holes 40 and 42 communicate with the annular space 46 which communicates with the upper surface of tube sheet 44.

As seen in FIG. 2, at the central part of the tube bundle 24, there is a space where there are no tubes 26. This is the space between the legs of the inverted U-shaped tubes. This space defines a tube lane 48 which is diametrically aligned between the hand holes 40 and 42.

Schematically shown at the hand hole 40 is the advance mechanism 4 which advances an elongated lance arm 50 carrying a jet head 52 on its outer end through the tube lane 48, which jet head 52 defines the jetting outlet 6 in the embodiment of FIG. 2.

Jets of fluid are ejected from the jet head 52 into the spaces between the tube rows, such as 28, 30, 32 and 34, to remove sludge material and the like which have collected between the tubes 26 on the tube sheet 44 and to move that material outward into the annular space 46.

A pair of flushing fluid injection lines 54 and 56 are placed through hand hole 40 and are directed in opposite directions into the annular space 46. The flushing fluid injection lines 54 and 56 define the flushing outlet 8 for the FIG. 2 embodiment.

In the operation of the cleaning apparatus particularly illustrated in FIG. 2, the apparatus is controlled to go through a cycle wherein it is indexed to a given position so that the nozzles of the jet head 52 are aligned with certain spaces between the tube rows, and then fluid is directed through the jet head 52 into the spaces between the tube rows to remove sludge material from between the tube rows and push it outward into the annular space 46. This continues for a period of thirty to sixty seconds in the preferred embodiment; however, other periods can be used. Then, the lancing or jetting cycle stops so that fluid flow to the jet head 52 is terminated. Thereafter, a flushing cycle begins wherein flushing fluid is directed to the flushing fluid injection lines 54 and 56 and travels in two semi-circular paths through the annular space 46 to wash the sludge around to a flushing fluid suction line 58 which is disposed through the second hand hole 42 defining the suction inlet 12 in the FIG. 2 embodiment. Indexing of the jet head 52 to the next adjacent space between tube rows occurs during the flushing cycle.

To extract the loosened sludge and fluid from the steam generator 2, the cleaning apparatus includes the evacuation skid 14 which is shown in FIG. 2 to include a suction pump 60 of a type as known to the art. The suction pump 60 draws the fluid and sludge from the steam generator through the hand hole 42 and provides the extracted fluid and sludge as a discharge flow into a discharge line 62 and a surge tank 64 associated therewith.

A booster pump 66 draws the fluid from surge tank 64 through a line 68 and directs it through a pair of filters 70 and 72 to a pressurizing pump 74 which directs it through another filter 76 to the valve manifold means 10. The pumps 66 and 74 and the related elements provide the fluid source means designated in FIG. 1 as the high pressure (HP) pump. In the preferred embodiment, the pressurizing pump 74 is of a suitable type as known to the art, such as a Halliburton Services HT-400 pump. Such a pump includes suction valves which can be lifted to relieve the pressure on the fluid flowing therethrough.

A flushing fluid supply line 78 connects the valve manifold means 10 to the flushing fluid injection lines 54 and 56. A lance fluid supply line 80 connects the valve manifold means 10 to the lance 50 and particularly to the jet head 52 for supplying lancing or jetting fluid to the jet head 52.

The cleaning apparatus shown in FIG. 2 can also include a second advance mechanism placed in the second hand hold 42. Typically, one advance mechanism will be extended only to approximately the center of the tube lane 48 so that it cleans one-half of the tube rows. Then, either that same advance mechanism will be moved to the second hand hole 42, or a second advance mechanism located at the hand hole 42 will be utilized. Although the disclosure of the present application describes the advance mechanism 4 as beginning near the hand hole 40 and then advancing forward towards the center of the tube lane 48, different cleaning patterns can be utilized which may, for example, begin at the center of the tube lane 48 and move outward to the hand hole 40, or may include any combination of movements which may traverse the tube lane 48 several times for complete cleaning.

Referring now to FIG. 3, a side elevational view of a particular embodiment of the advance mechanism 4 and elongated lance arm 50 will be described. The advance apparatus 4 of the FIG. 3 embodiment includes a frame 82. A lead screw 84 is rotatably disposed in the frame 82.

An electric stepping motor 86 is connected to the frame 82. Drive means 88 is connected between the stepping motor 86 and the lead screw 84 for rotating the lead screw 84 upon rotation of a shaft 90 of the stepping motor 86.

A lance carrier 92 has an internal screw thread which engages the lead screw 84. The lance carrier 92 and lead screw 84 are so arranged and constructed that the lance carrier 92 is moved longitudinally relative to the lead screw 84 as the lead screw 84 is rotated relative to the lance carrier 92. A hand wheel means 96 is attached to an end shaft 98 of the lead screw 84.

The advance mechanism 4 also includes a holder means 100, which is attached to the frame 82 by cap screws 102 and 104 for slidably receiving a portion of the lance 50 which is located forward of the lance carrier 92.

The stepping motor 86 is mounted on a rearward side 106 of an upper part of a plate portion 108 of the frame 82 so that the shaft 90 of the stepping motor 86 is oriented substantially parallel to the lead screw 84 and extends forward through an opening of the plate portion 108.

The drive means 88 includes a first pulley 110 attached to the shaft 90 of the stepping motor 86. It also includes a second pulley 112 attached to another end of the lead screw 84. The drive means 88 also includes a drive belt 114 which engages the first and second pulleys 110 and 112. Preferably, the drive belt 114 is a toothed drive belt and the pulleys 110 and 112 are toothed pulleys so that a positive drive is provided between stepping motor 86 and the lead screw 84, thereby preventing any slippage of the stepping motor 86 relative to the lead screw 84.

Also shown in FIG. 3 are limit switches 116 and 118 which detect and react to limit, and thereby define, the forwardmost and rearwardmost extremities of travel of the lance 50. This limitation occurs by providing suitable control signals to the motor controller means 18 when either of the limit switches 116 or 118 is actuated in response to engagement by the lance carrier 92. In the preferred embodiment, these control signals are provided as neutral or non-voltage signals in that during travel of the lance 50 between its forwardmost and rearwardmost extremities, a voltage is provided through the limit switches 116 and 118 to indicate that neither limit has been reached; but when an extremity is reached, then the signal is switched to a neutral potential to signify a limit has been reached. Therefore, in the preferred embodiment it can be said that the control signals are inhibiting signals which arise through the inhibiting of the voltage signals provided during movement of the lance 50 between its travel extremities.

FIG. 3 also discloses that the illustrated lance 50 includes an internal thread 120 to which the jet head 52 is connected. Fluid flow is provided to the jet head 52 through the lance fluid supply line 80, a portion of which is illustrated in FIG. 3.

With reference now to FIGS. 4–10B, the preferred embodiment of the control system for controlling the above-described cleaning apparatus will be more particularly described.

Figure 4:
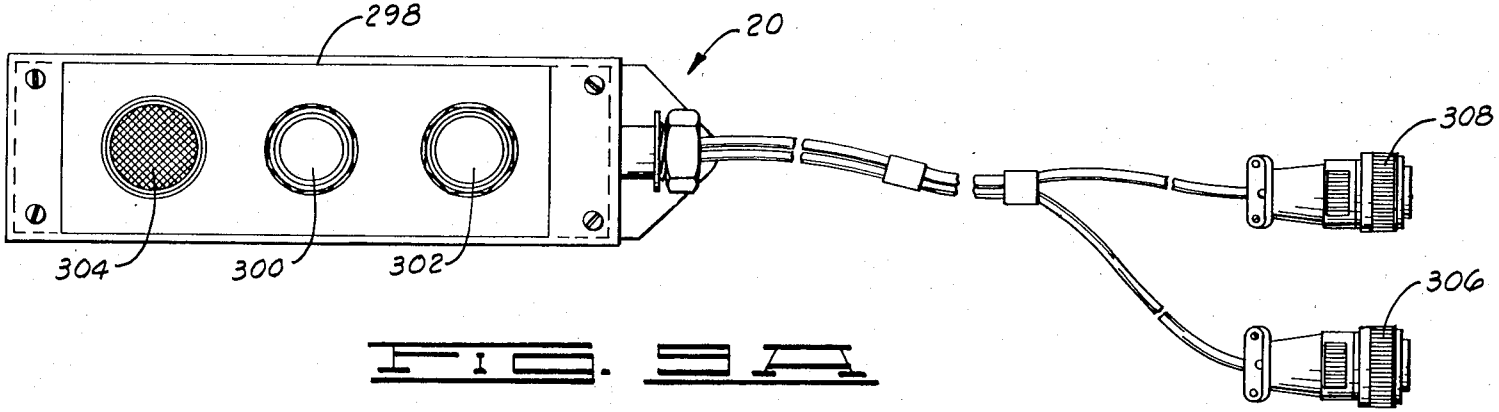
FIG. 4 is a schematic circuit diagram of the valve manifold control means of the preferred embodiment of the present invention.
Figure 4:
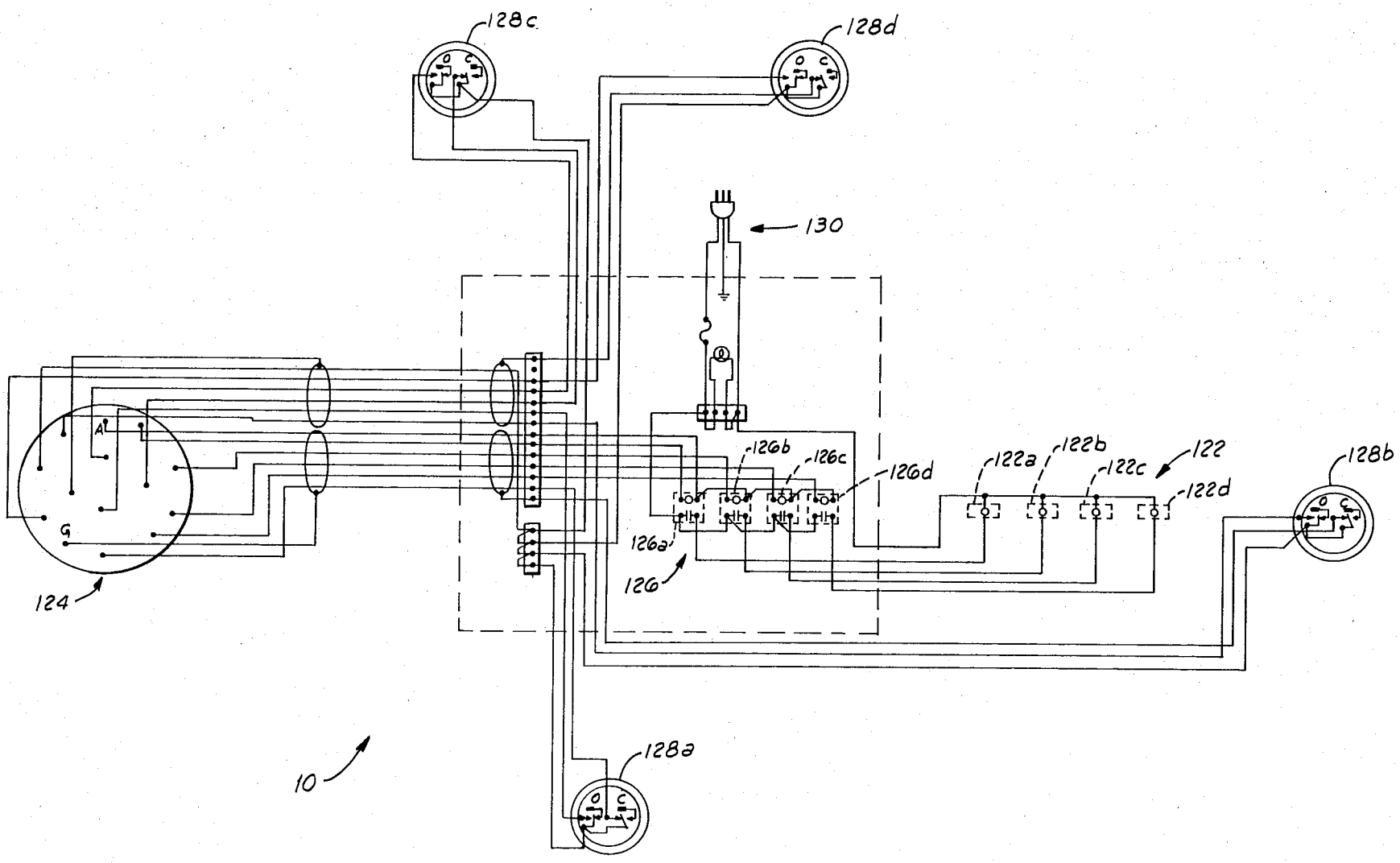

The pressurized fluid from the pressurizing pump 74 is applied to either the flushing fluid supply line 78 or the lance fluid supply line 80 via the valve manifold means 10. The circuitry of the preferred embodiment of the valve manifold means 10 is shown in FIG. 4.

The valve manifold means 10 includes a plurality of valves of suitable types as known to the art. In the preferred embodiment the valves include hydraulic valves controlled by pneumatic valve actuators which respond to air solenoids 122 shown in FIG. 4. FIG. 4 specifically discloses that there are four valves in the preferred embodiment, with each valve being associated with one of the four air solenoids 122*a*, 122*b*, 122*c*, and 122*d* shown in FIG. 4. Each of the valves is movable by its respective air solenoid 122 between an open position and a closed position. By appropriate control of the air solenoids 122, the pressurized fluid is communicated with the flushing fluid supply line 78, or the lance fluid supply line 80, or the corresponding lines associated with the second cleaning apparatus with which the preferred embodiment valve manifold means 10 can be associated.

Actuation of the air solenoids 122 occurs in response to a suitable control signal provided by the control console 16 through an electrical connector 124 of the valve manifold means 10. The control signal is coupled through the connector 124 and provided to a set of relays 126 having a plurality of relays 126*a*, 126*b*, 126*c* and 126*d*, each one of which is associated with a respective one of the air solenoids 122*a*, 122*b*, 122*c*, and 122*d* as shown in FIG. 4. When an appropriate control signal is received by one of the relays 126, the corresponding air solenoid is actuated to move the associated double-acting pneumatic valve actuator whereby the associated hydraulic valve is moved to open a flow path for the pressurized fluid from the pressurizing pump 74 to the selected one of the fluid supply lines. Movement of a pneumatic valve actuator causes movement of the respective one of a plurality of associated valve actuator switches 128*a*, 128*b*, 128*c*, and 128*d*.

Each valve actuator switch 128 can be placed either in a first position indicating that the associated valve is open or a second position indicating that the valve is closed. The signal provided by the placement of a respective one of the switches 128 in either of these positions is provided to the control console 16 via the connector 124.

Electrical energy is provided to the valve manifold means 10 via a power supply line 130 which, in the preferred embodiment, is connectible to a standard 110-volt AC power supply.

Associated ones of the air solenoids 122, relays 126 and valve actuator switches 128 are identified in FIG. 4 by the corresponding letters a, b, c or d.

During normal operation of the preferred embodiment valve manifold means 10, only one of the air solenoids 122*a*, 122*b*, 122*c* and 122*d* is open at any one time so that only a single flow of fluid is provided into the steam generator 2.

Once the fluid has been provided to one of the supply lines and flowed into the steam generator 2, suction is then applied by means of the pump 60 to remove the fluid and loosened sludge from the steam generator 2. The pump 60 forms a part of the evacuation skid 14 identified in FIG. 1. In the preferred embodiment the evacuation skid 14 has a control circuitry as shown in FIG. 5.

Figure 5:
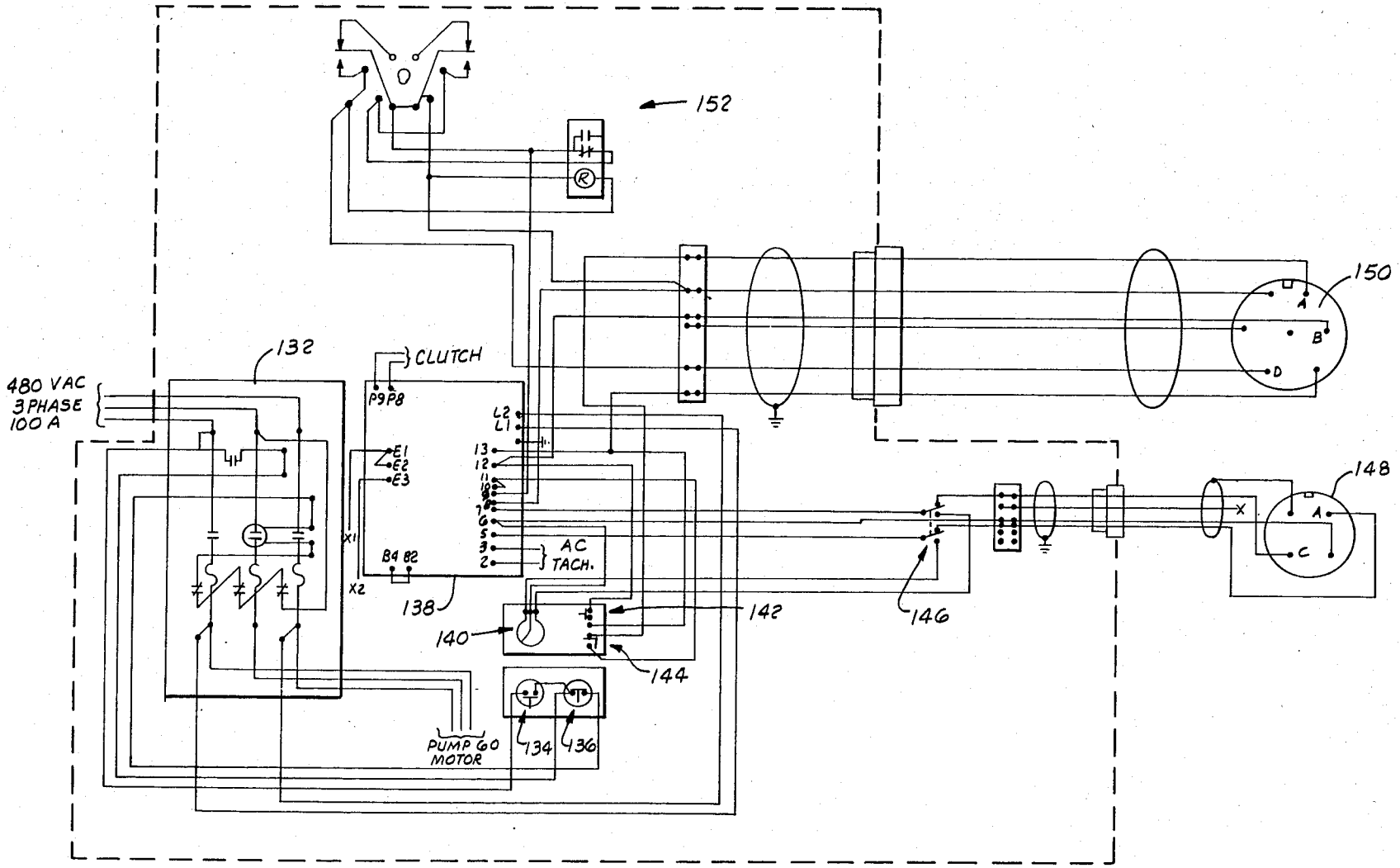
FIG. 5 is a schematic circuit diagram of the evacuation skid circuitry of the preferred embodiment of the present invention.
Figure 5:
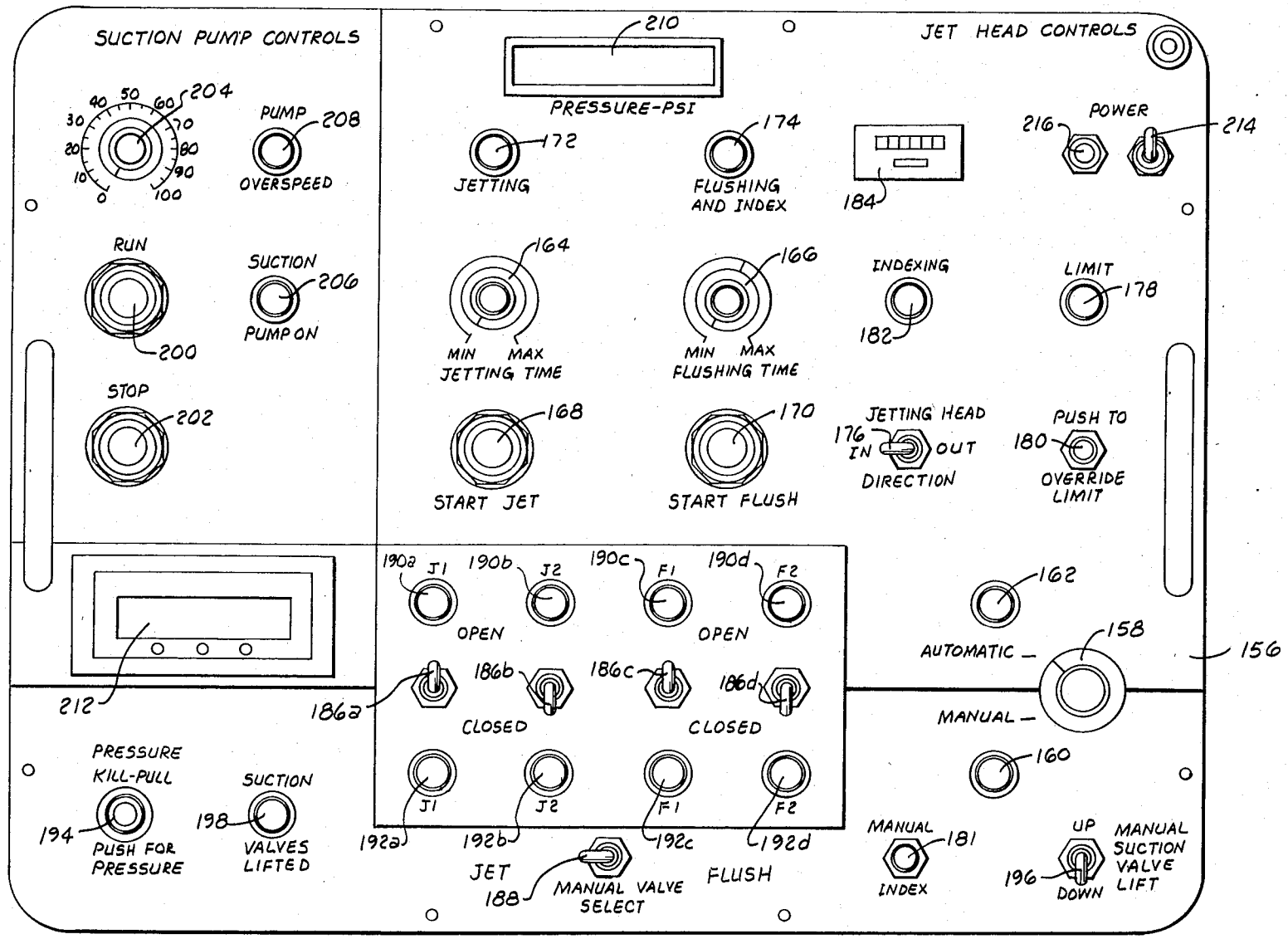

The control circuitry of the evacuation skid shown in FIG. 5 includes a motor starter 132 which is a NEMA size 4 motor starter as known to the art. The motor starter 132 provides a starting current to a drive motor of the pump 60. In the preferred embodiment, the motor is a Louis-Allis 60-horsepower motor. The motor starter 132 is controlled in response to actuation of a start switch 134 or a stop switch 136.

The evacuation skid also includes a motor controller 138, such as a Louis-Allis MC-5 motor controller as known to the art. The motor controller 138 provides a control signal to the clutch of the pump 60 and its motor. Local control of the motor controller 138 is maintained by suitable actuation of a speed selector switch 140, a run switch 142, and a stop switch 144. Local control is maintained if a local/remote switch 146 is placed in the position opposite that shown in FIG. 5.

For the position of the remote/local switch 146 shown in FIG. 5, remote control of the speed can be effected from the control console 16 when it is connected to the evacuation skid circuitry via an electrical connector 148. Remote control of the run and stop modes of operation of the motor controller 138 can also be effected from the control console 16 with suitable signals provided through an electrical connector 150.

The evacuation skid circuitry shown in FIG. 5 also includes an overspeed protection circuit 152.

The control console 16 includes a control panel 156 (FIG. 6) from which the control of the valve manifold means 10 and the evacuation skid 14 is performed. The control panel 156 also includes controls for controlling the motor controller means 18 and the suction valves of the pressurizing pump 74. The interface mechanisms by which an operator can control or provide direction to the control of the other devices will be described with reference to FIG. 6.

A first portion of the control panel 156 includes means for placing the present invention in either an automatic or a manual mode and means for controlling the timing of the automatic operation of the present invention. This section includes an automatic/manual mode selector switch 158 having lamps 160 and 162 associated therewith. The lamp 160 is illuminated when the switch 158 is placed in the manual mode position, and the lamp 162 is illuminated when the switch 158 is placed in the automatic mode position. The timing means of the present invention includes a jetting time selector switch means having a knob 164 for controlling the time period during which the pressurized fluid is provided to the lance fluid supply line 80. The timing means also includes a flushing time selector switch means having a knob 166 for controlling the time period during which the pressurized fluid is provided to the flushing fluid supply line 78. The knobs 164 and 166 are connected to potentiometers as shown in FIG. 7A. The timing means also includes a push-button switch 168 for starting the cleaning operation with a jetting cycle and a push-button switch 170 for starting the cleaning operation with a flushing cycle. When a jetting cycle is being performed, a lamp 172 is illuminated; and when a flushing and indexing cycle is being performed, a lamp 174 is illuminated.

A second section of the control panel 156 includes controls for directing the operation of the motor controller means 18. This control section includes a toggle switch 176 which determines the direction of travel along which the motor controller means 18 moves the lance 50. When the lance has been moved to one of its travel extremities, a limit lamp 178 is illuminated and the automatic timing signals provided in response to the setting of the controls 164 and 166 are overridden so that no further automatic jetting or flushing occurs. This limiting function can be overridden in response to the actuation of a push-button limit override switch 180. FIG. 6 shows that this portion of the control panel 156 also includes a lamp 182 which is illuminated when the motor control means 18 has been instructed to index, or incrementally move, the lance 50. The number of such indexing, or incremental, steps is counted and displayed in a counter 184. Indexing occurs either automatically or manually as will be further described hereinbelow. Manual indexing occurs in response to actuation of a push-button switch 181.

A third portion of the control panel 156 shown in FIG. 6 is the valve selector means for controlling which valves of the manifold valve means 10 are to be utilized. The valves to be utilized are selected by appropriately setting toggle switches 186*a*, 186*b*, 186*c*, and 186*d* which are associated with the respectively lettered ones of the relays 126a–d and air solenoids 122*a–d* shown in FIG. 4. With the switches 186*a–d* positioned as shown in FIG. 6, the flushing and jetting valves associated with the supply lines 78 and 80, respectively, are the ones which will be actuated in response to the automatic control established in response to the setting of the controls 164 and 166 if the switch 158 is in the automatic mode position or in response to actuation of a manual valve select switch 188 if the switch 158 is in the manual mode position. The switches 186*b* and 186*d* are associated with a second cleaning apparatus having a second advance apparatus not shown in the drawings, but which is contemplated to be associated with the hand hole 42 in a manner similar to that in which the advance mechanism 4 is associated with the hand hole 40. Once the switches 186*a–d* are properly set and control of the valve manifold means 10 established, respective ones of lamps 190*a*, 190*b*, 190*c* and 190*d* are illuminated to indicate those valves which are open and respective ones of lamps 192*a*, 192*b*, 192*c* and 192*d* are illuminated to indicate which of the valves are closed.

A fourth section of the control panel 156 includes controls for lifting the suction valves of the pressurizing pump 74. These controls include a pressure kill switch and lamp 194 which can be actuated at any time to lift the suction valves of the pump 74 and thereby relieve pressure from the fluid. A toggle switch 196 provides another means for lifting the suction valves of the pump 74; however, the switch 196 is operable only when the switch 158 is in the manual mode position. When the suction valves have been lifted, a lamp 198 is illuminated.

The aforementioned control of the suction pump 60 which can be effected from the control panel 156 is achieved through proper actuation of the controls shown in the upper left-hand section of the control panel 156 shown in FIG. 6. These controls include a push-button run switch 200, a push-button stop switch 202 and a potentiometer control knob 204 which controls a potentiometer used for remotely setting the speed at which the suction pump 60 is to operate. When the suction pump 60 is operating, a lamp 206 is illuminated; and when the pump is operating at an overspeed condition, a lamp 208 is illuminated.

The control panel 156 also includes a pressure indicating meter 210 by means of which the magnitude of the pressure on the fluid flowing through the valve manifold means 10 is displayed. The control panel 156 also includes a time clock 212 and a power on/off switch 214. The switch 214 has a fuse or other suitable circuit breaker means 216 associated therewith.

With reference now to FIGS. 7A–7F, the aforementioned controls found on the control panel 156 will be schematically shown in association with their control circuits which are also associated with the control panel 156 and which also form parts of the control console 16.

FIG. 7A discloses the preferred embodiment of the automatic/manual mode selector switch 158 and the associated lamps 160 and 162. FIG. 7A shows that the preferred embodiment switch 158 is a 10-pole, double-throw rotary switch.

FIG. 7A also discloses the circuitry incorporating the control panel elements 164–174. These elements are included within the timing means for providing a jetting control signal to the valve manifold means 10 to cause the valve manifold means 10 to communicate the pressurized fluid with the selected lance fluid supply line and for providing a flushing and indexing control signal to the valve manifold means 10 to cause the valve manifold means 10 to communicate the pressurized fluid with the selected flushing fluid supply line. The flushing and indexing signal is also used to control the motor control means 18 to index the stepping motor 86 to move the lance 50.

The timing means particularly includes in the preferred embodiment a jetting timer means 218 for providing the jetting control signal via an electrical conductor means 220 to the valve manifold means 10 to open the valve thereof which is associated with the lance fluid supply line selected by the switches 186*a* and 186*b* shown in FIGS. 6 and 7C. The jetting timer means includes a relay means 222 responsive to the setting of the control knob 164 and associated potentiometer for automatically periodically providing the jetting control signal over the conductor means 220. The timing means also includes a flushing timer means 223 for providing the flushing and indexing control signal via an electrical conductor means 224 to the valve manifold means 10 to open the flushing valve of the flushing fluid supply line selected by either the switch 186*c* or or switch 186*d*. The signal is generated by another relay means 226 which is responsive to the setting of the control knob 166 and its associated potentiometer. The flushing and indexing control signal generated by the relay means 226 is provided, when the switch 158 is in the automatic mode position, to an indexing means shown in FIG. 7B. This signal is provided over an electrical conductor means 228.

The jetting timer means 218 and the flushing timer means 223 are operable when a power relay means 230 is actuated. The jetting timer means 218 or the flushing timer means 223 which is to provide its control signal first is selected by suitable actuation of either the start jet switch 168 or the start flush switch 170. Thereafter, control signals are alternately periodically generated to alternately periodically lance and flush the steam generator 2.

When the lance 50 has been advanced by the motor controller means 18 to one of its travel extremities, a timing means control signal is provided by the motor controller means 18 and communicated to the control console 16, via an electrical conductor means 232, for deactivating a relay means 234 so that the power relay means 230 and, thus, also the jetting timer means 218 and the flushing timer means 223 are deactivated. This deactivation prevents the jetting and the flushing and indexing control signals from being provided over the conductor means 220, 224 and 228. In the preferred embodiment the timing means control signal is an inhibiting signal in that it occurs through the inhibiting of a voltage which is normally present on the conductor means 232 when a travel extremity has not been reached.

It is to be noted that in the preferred embodiment the jetting timer means 218 and the flushing timer means 223 operate in an EXCLUSIVE OR manner wherein one of the timer means is not providing its control signal when the other one is. This provides an alternating fluid flow in the steam generator 2 wherein either a jetting stream is provided from the jet head 52 or a flushing stream is provided from the flushing heads 54 and 56.

Figure 7:
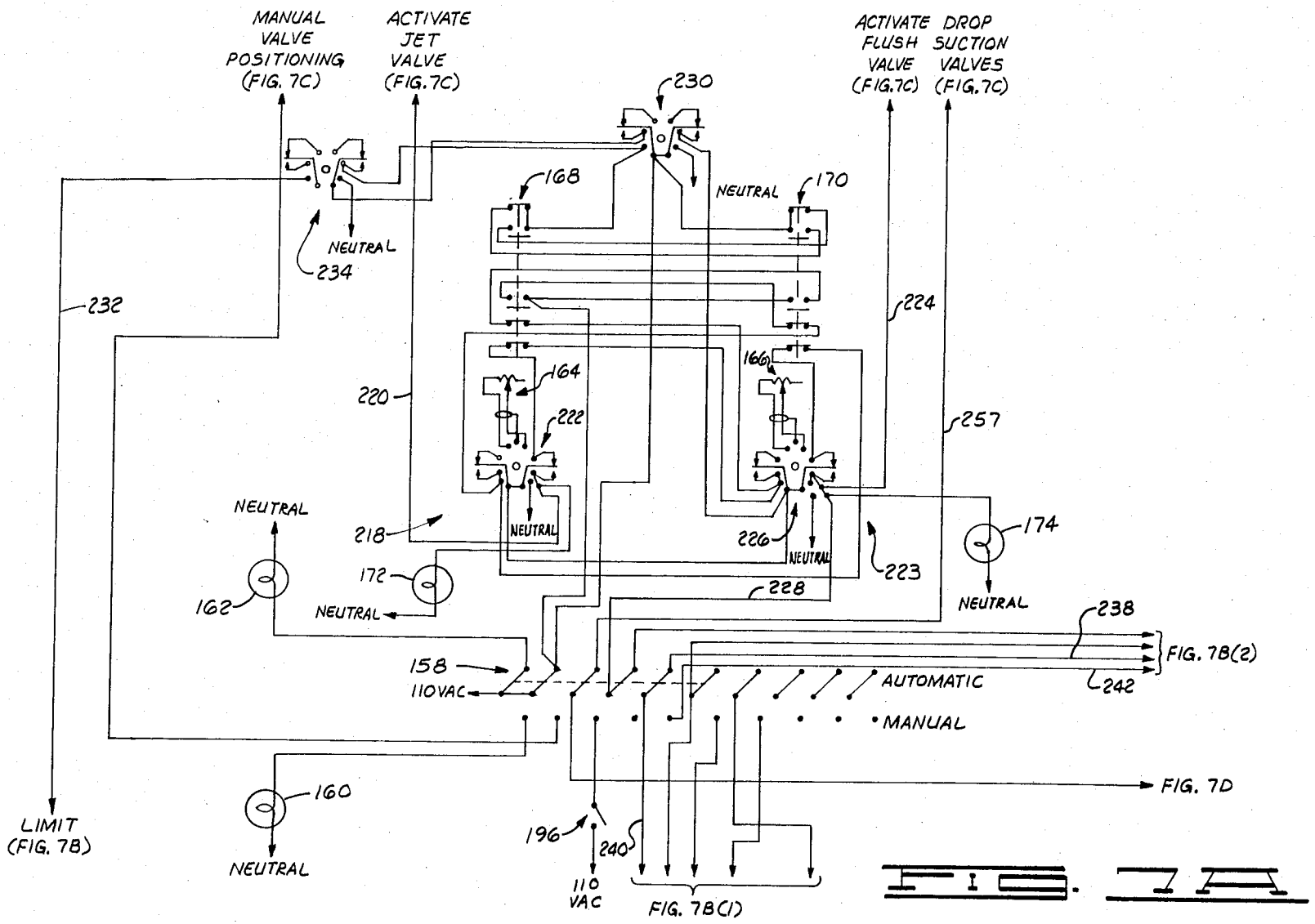
FIGS. 7A–7F are schematic circuit diagrams of the control console of the preferred embodiment of the present invention.
Figure 7B:
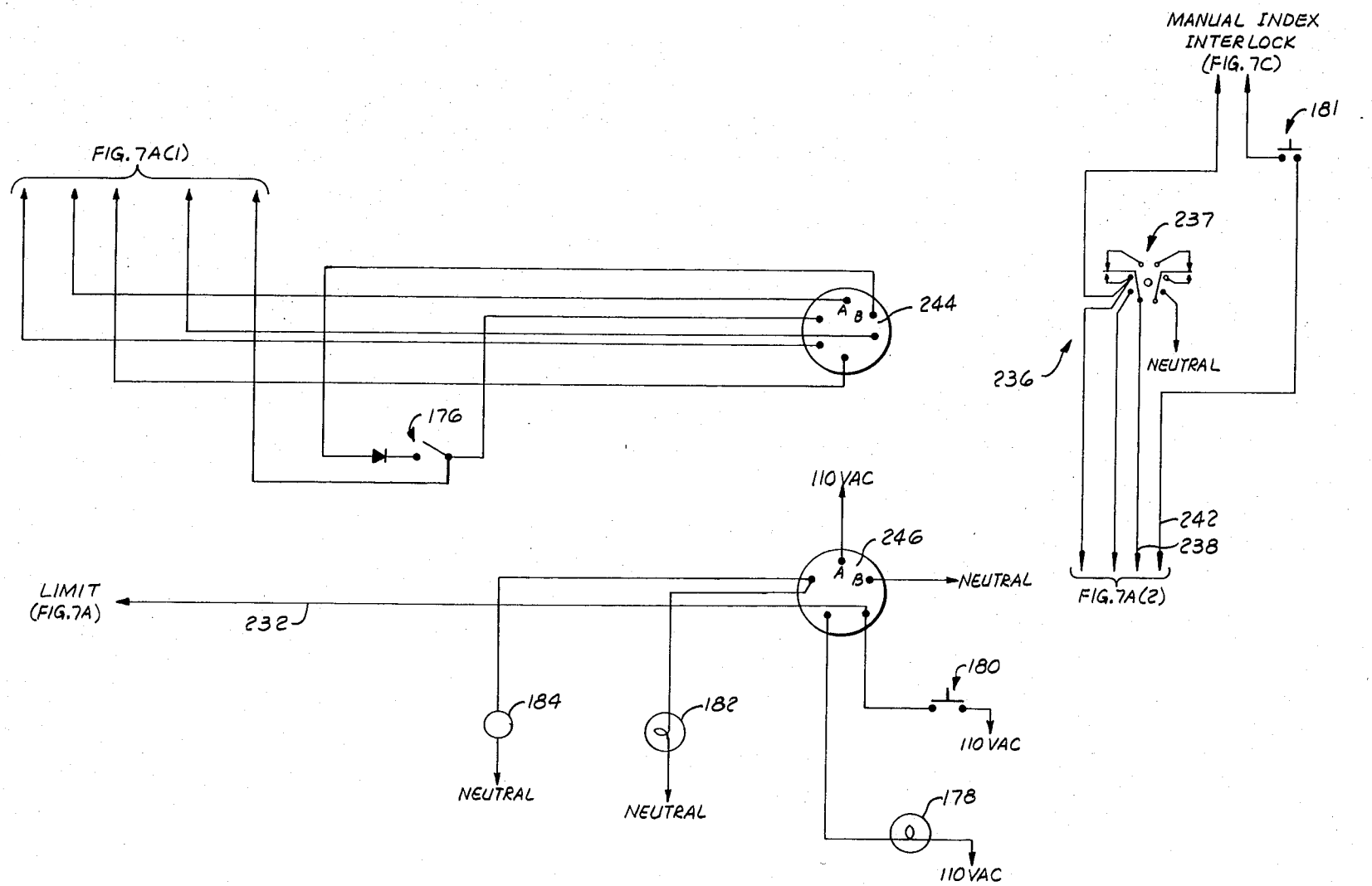

The indexing means which receives the flushing and indexing control signal from the flushing timer means 223 over the conductor means 228 is shown in FIG. 7B and identified by the reference numeral 236. The indexing means 236 includes a relay means 237 and the manual indexing switch 181.

When the mode selector switch 158 is in the automatic mode position, the indexing means 236 automatically provides an automatic indexing signal over electrical conductor means 238 and 240 to the motor controller means 18 in response to a signal over the conductor means 228.

When the mode selector switch 158 is in the manual position, the indexing means 236 provides a manual indexing signal over a conductor means 242 and the conductor means 240 when the switch means 181 is manually actuated.

The indexing means 236 is constructed so that it is inhibited from providing an indexing signal to the motor control means 18 whenever the present invention is in a jetting cycle. That is, indexing in the preferred embodiment can occur only during a flushing cycle. When a flushing cycle is occurring and an indexing signal is provided over the conductor means 240, the motor controller means 18 indexes the lance 50 a distance, or increment, which has been preset in the motor controller means 18 as will be subsequently described. The direction of the indexing, or movement, of the lance 50 occurs in the direction as established by the setting of the direction switch 176 which is schematically illustrated in FIG. 7B.

FIG. 7B also discloses an electrical connector 244 which is connectible with the motor controller means 18 as will be subsequently described. FIG. 7B shows another electrical connector 246 which is connectible with the motor controller means 18 as will also be subsequently described. The aforementioned timing means control signal is provided to the conductor means 232 via the connector 246 as shown in FIG. 7B. This timing means control signal (i.e., the inhibition of the voltage normally present on the conductor means 232 in the preferred embodiment) can be overridden by manual actuation of the limit override switch 180. When the override switch 180 is actuated, the relay 234 is activated (i.e., a voltage is applied to the conductor means 232) so that the timing means is not deactivated.

FIG. 7B also shows that the connector 246 has the limit indicator lamp 178, the indexing lamp 182, and the indexing counter 184 associated therewith.

FIG. 7C discloses the portion of the control console 16 directly associated with the valve manifold means 10. This association is effected via an electrical connector 248 which is constructed for mating engagement with the connector 124 shown in FIG. 4.

This portion of the control console 16 includes the manifold valve selector switches 186*a–d* and the associated manual valve select switch 188. The switches 186*a–d* are logically arranged in an EXCLUSIVE OR manner so that only one jet line or one flush line can be opened at any one time.

Also shown in FIG. 7C to be associated with the connector 248 are the manifold valve status/position indicator lamps 190*a–d* and 192*a–d*.

Also included in the portion of the control console 16 shown in FIG. 7C is a monitor means for monitoring the status (i.e., the open or closed position) of the valves of the valve manifold means 10. The monitor means is shown particularly as a manifold valve position logic circuit means 250 having eight relays 252*a*, 252*b*, 252*c*, 252*d*, 254*a*, 254*b*, 254*c*, and 254*d* which are used to indicate, in response to signals from the valve actuator switches 128*a*, 128*b*, 128*c*, and 128*d*, whether respective ones of the valves of the valve manifold means 10 are in their open or closed positions. The relays 252*a–d* indicate the open status, and the relays 254*a–d* indicate the closed status.

Through the operation of the valve position logic circuit means 250, those combinations of signals which would cause simultaneous jetting and flushing in the steam generator 2 are inhibited. This inhibition is achieved by generating signals which cause the suction valves of the pump 74 to be maintained in an open position until only one jet valve is open and all flush valves are closed or until only one flush valve is open and all jet valves are closed. The suction valves are also lifted when all of the valves are closed (in the preferred embodiment this is detected by monitoring the valve open signals to determine if any valves are open; if not, it is presumed that all are closed). This control is maintained only when the switch 158 is placed in the automatic mode position; however, the circuit 250 provides an inhibiting signal if all of the valves are closed when the switch 158 is in the manual mode position. The circuit means 250 signal indicating that all the valves are closed is provided over an electrical conductor means 256 shown in FIGS. 7C and 7D. The circuit means 250 signal indicating that only one jet or flush valve is open, thereby signifying the suction valves should be closed, is provided over a conductor means 257.

Figure 7E:
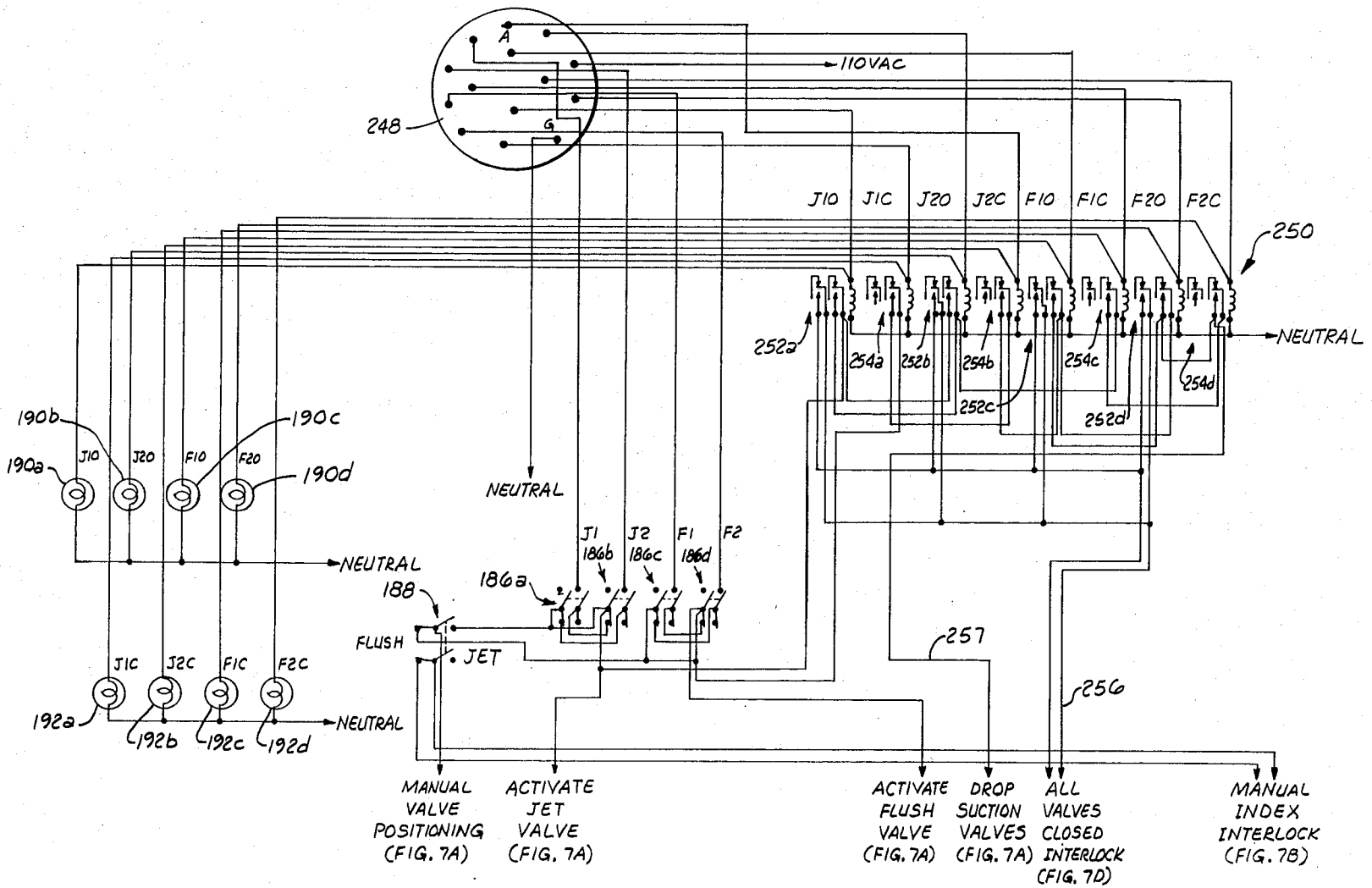
Figure 7D:
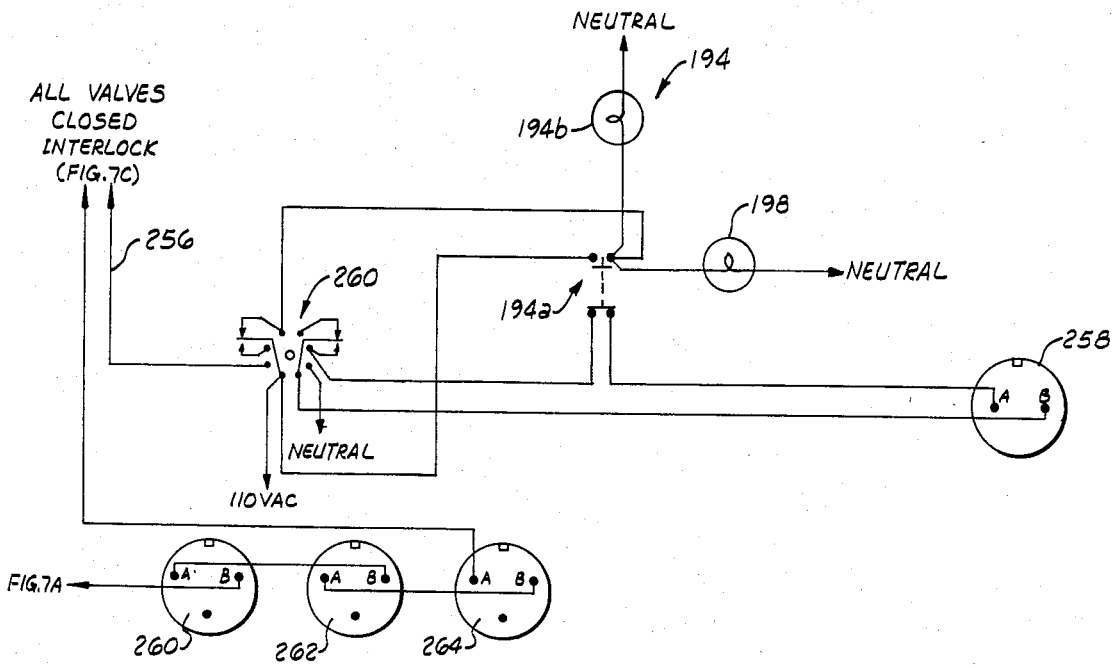
Figure 7E:
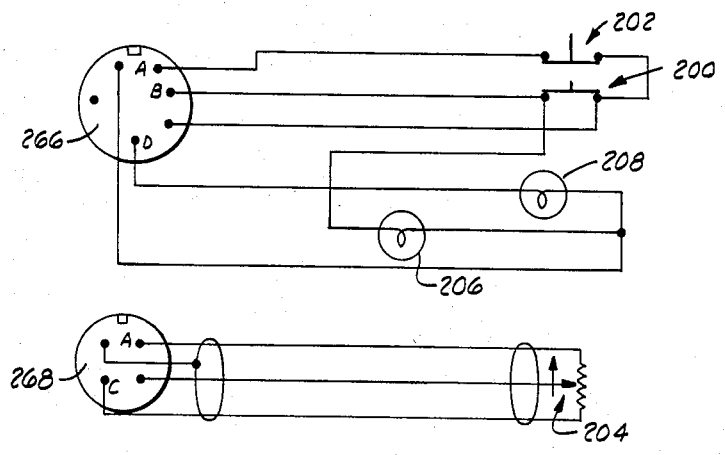

The circuitry for interfacing with the suction valve circuitry of the pump 74 is shown in FIG. 7D. This interfacing circuitry and the signals to which it responds provides the means for controlling the fluid source including the pump 74 in the preferred embodiment. Connection with the pump 74 is made by means of an electrical connector 258. Connected to the connector 258 is a relay means 260 having the conductor means 256 connected thereto. The conductor means 256 provides one portion of a series circuit which also includes the logic circuit 250 and electrical connectors 260, 262, and 264 which are used for connecting with respective ones of the remote pressure kill controller devices generally identified in FIG. 1 by the reference numeral 22. Also associated with the relay 260 are the pressure kill switch 194, which includes a switch mechanism 194*a* and a lamp 194*b*, and the suction valve lifted indicator lamp 198.

The relay means 260 and the suction valve lift circuitry associated therewith maintain the suction valves raised when all the valves of the valve manifold means 10 are closed, or when a jet and a flush valve of the valve manifold means 10 are both open at the same time, or when there has been a loss of electrical power at either the control console 16 or the valve manifold means 10, or when there has been a loss of air pressure at the valve manifold means 10, or when the control console 16 and the valve manifold means 10 have become disconnected. The relay means 260 operates in an electrically activated state to hold the suction valves closed during normal operating conditions so that a "dead man" operation is achieved wherein power must be maintained in the control system for the pump 74 to pump the fluid.

The suction valve relay 260 is also responsive to the signal provided by the logic circuit 250 over the conductor means 257 when the mode selector switch 158 is in the automatic mode position (see FIGS. 7A, 7C and 7D). When the switch 158 is in the manual mode position, the conductor means 257 is disconnected from the suction valve relay 260 and, in its place, there is connected the manual suction valve lift switch 196 as shown in FIG. 7A. The switch 196 is collocated with the mode selector switch 158 in the sense that they both are located on the control panel 156.

FIG. 7E discloses the circuitry of the control console 16 which provides the remote control of the suction pump 60. This circuitry includes the control panel elements 200–208 described hereinabove. The elements 200, 202, 206, and 208 are connected to an electrical connector 266 which is constructed for mating engagement with the connector 150 shown in FIG. 5. The control knob 204 and related potentiometer shown in FIG. 7E are connected to an electrical connector 268 which is constructed for mating engagement with the connector 148 shown in FIG. 5. When the connectors 150 and 266 and the connectors 148 and 268 are connected, and when the switch 146 is placed into the position shown in FIG. 5, both run/stop control and speed control of the suction pump 60 can be achieved from the control panel 156.

Figure 7F:
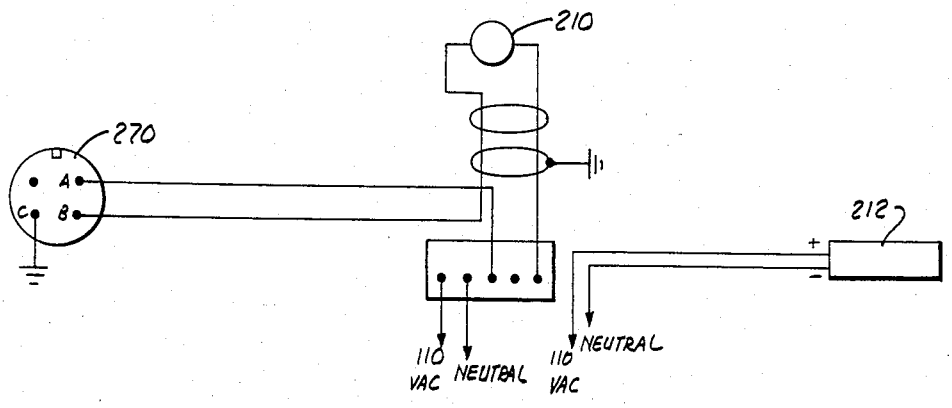
Figure 11:
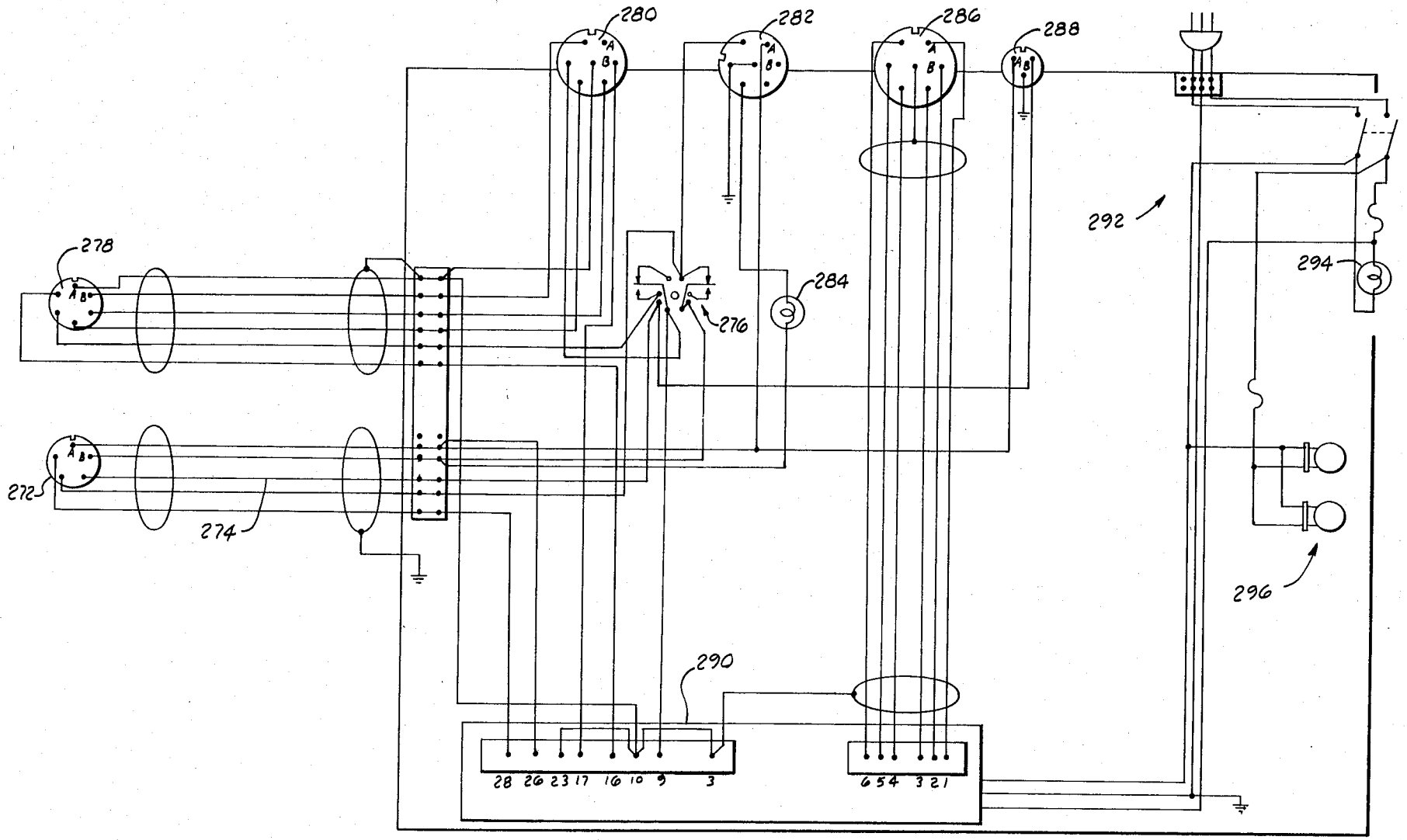

FIG. 7F discloses the schematic diagram of the circuitry incorporating the pressure indicator 210 and the clock 212. The pressure indicator 210 is connected, by a suitable electrical connector 270, to a pressure transducer (not shown) located in the preferred embodiment at the valve manifold means 10.

With reference to FIG. 8, the motor controller means 18 will be described. The motor controller means 18 can be more broadly referred to as an advance mechanism control means for controlling the distance the advance mechanism 4 moves the jetting outlet 6. More particularly, the motor controller means 18 controls the incremental distance that the stepping motor 86 moves the lance 50 and the jet head 52 connected thereto.

The motor controller means 18 includes means for providing the timing means control signal (i.e., for the preferred embodiment the neutral or non-voltage signal resulting from the inhibition of the voltage normally applied to the conductor 232 when the lance is not at either travel extremity) to the control console 16 to control the relay 234 to terminate the operation of the timing means shown in FIG. 7A. This timing means control signal arises in response to the limit signal received from the advance mechanism 4, which limit signal in the preferred embodiment is the inhibition of a voltage, or in other words the switching from a non-neutral potential to a neutral potential, which occurs when the lance carrier 92 engages one of the limit switches 116 or 118. The timing means control signal is communicated to the control console 16 through an electrical connector 272 constructed for mating engagement with the connector 246 shown in FIG. 7B. This signal is provided to the connector 272 over an electrical conductor means 274 extending from a relay means 276 forming another part of the motor controller means 18.

The motor controller means 18 is also coupled to the control console 16 through an electrical connector 278 which is constructed for mating engagement with the connector 24 shown in FIG. 7B.

The motor controller means 18 is also associated with electrical connectors 280 and 282 which provide for coupling with the platform control box 20 shown in FIGS. 1 and 2 and more particularly described hereinbelow with reference to FIGS. 9A–9B. When the motor controller means 18 is connected to the platform control box 20 through the connectors 280 and 282 and control is provided from the platform control box, a lamp 284 is illuminated.

The motor controller means 18 also includes electrical connectors 286 and 288 which connect with matching connectors (not shown) on the stepping motor 86.

FIG. 8 also shows that the motor controller means 18 includes a preset indexer 290, such as a type SP 155A preset indexer of Superior Electric Company of Bristol, Conn. The preset indexer 290 is operable in a manner as known to the art to establish a preset indexing length by which the stepping motor 86 will move the lance 50 in response to an indexing command from the control console 16.

The motor controller means 18 also includes a power circuit means 292 having a lamp 294 associated therewith for indicating when the motor controller means 18 has power applied thereto.

The motor controller means 18 also includes fans 296 for cooling the components thereof.

Figure 9B:
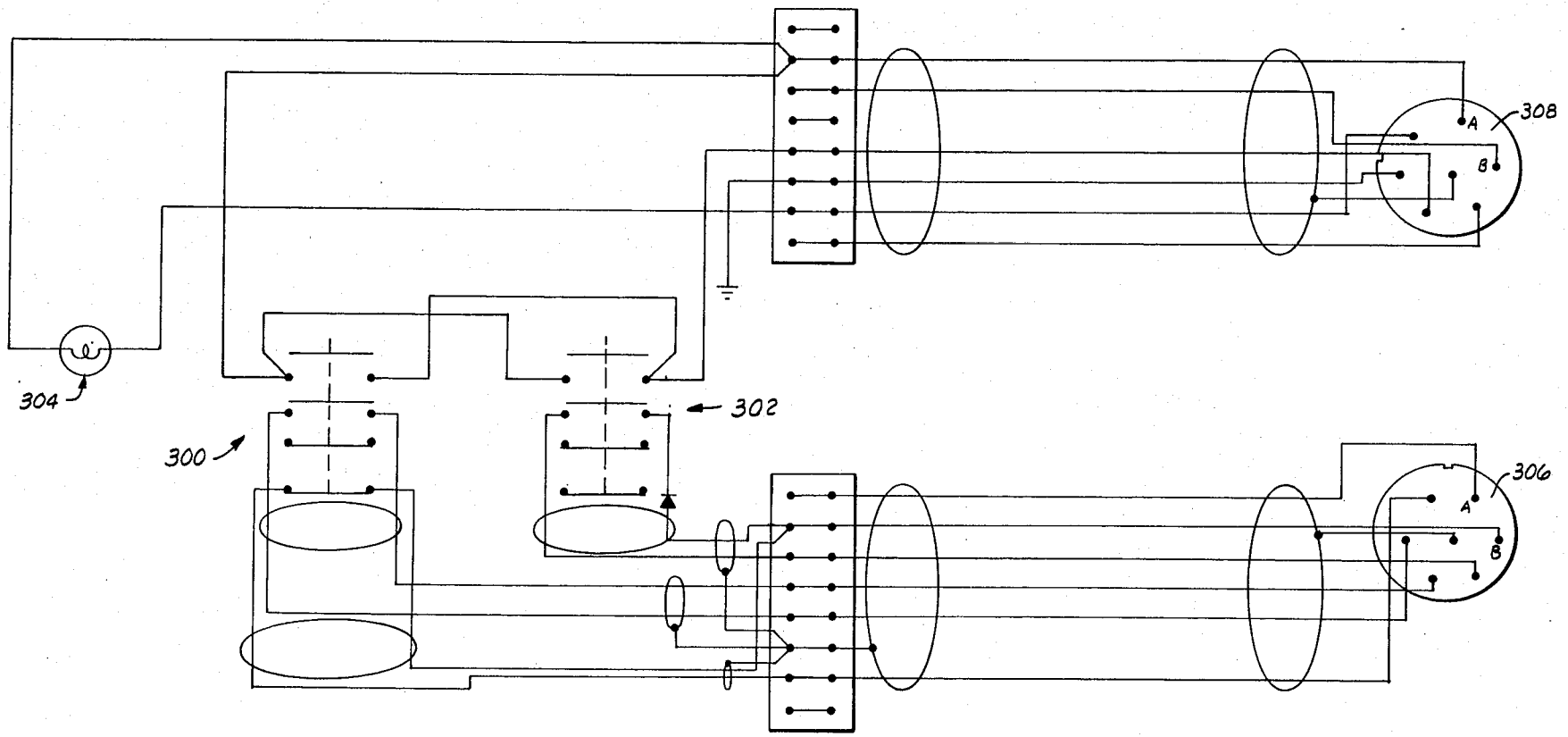
FIG. 9B is a schematic circuit diagram of the platform control box of the preferred embodiment of the present invention.

With reference to FIGS. 9A–9B, the preferred embodiment of the platform control box 20 will be described. The platform control box 20 provides means for manually controlling the motor controller means 18 from a location spaced from the control console 16 and the motor controller means 18. The platform control box 20 is used in the contemplated preferred embodiment of use at the steam generator 2 platform for setting the limit switches and for performing other manual operations during the set up and alignment of the advance mechanism 4. In the preferred embodiment the platform control box 20 can control the motor controller means 18 only when the control console 16 is in the manual mode as set by the mode selector switch 158.

As shown in FIG. 9A, the platform control box 20 includes a housing 298 having a push-to-index switch 300 and a hold-to-index-in switch 302 mounted therein. The housing 298 also has a lamp 304 mounted therein for indicating when the advance mechanism 4 has moved the lance 50 to one of its limits of travel. The housing 298 is connected to the motor controller means 18 by means of an electrical connector 306 and an electrical connector 308 and the associated cabling shown in FIG. 9A. The connector 306 is constructed for mating engagement with the connector 280 shown in FIG. 8, and the connector 308 is constructed for mating engagement with the connector 282 shown in FIG. 8.

FIG. 9B discloses a schematic circuit diagram of the platform control box 20.

Figure 10A:
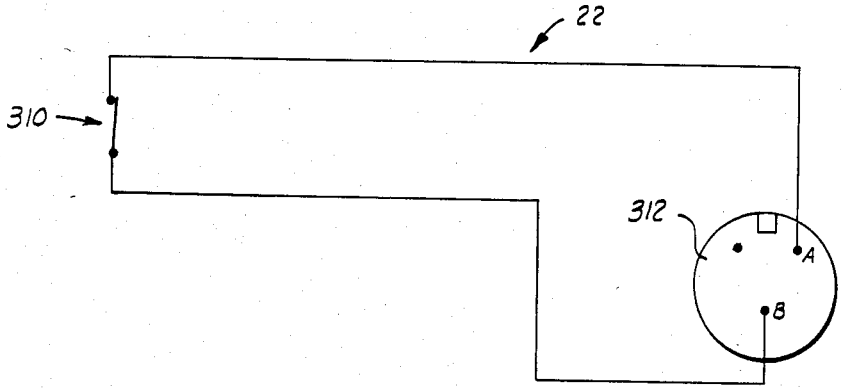
FIG. 10A is a schematic circuit diagram of the remote pressure kill controller means of the preferred embodiment of the present invention.
Figure 10B:
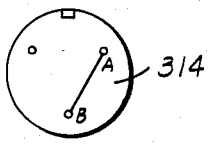
FIG. 10B is a schematic diagram of a jumper connector used on the control console in place of the device shown in FIG. 10A.

With reference to FIG. 10A, the preferred embodiment of one device of the remote pressure kill controller means 22 will be described. The device includes a switch 310 connected to an electrical connector 312 which is constructed for mating engagement with any one of the connectors 260, 262 or 264 shown in FIG. 7D. When the connector 312 is connected to one of the connectors 260, 262, or 264, opening of the switch 310 will cause the suction valves of the pump 74 to be lifted if the connector 258 shown in FIG. 7D is connected to the pump 74. This control of the suction valves occurs regardless of the state of the manifold 10 valves or of the valve position logic means 250. It is contemplated that one or more of these devices of the remote pressure kill controllers 22 will be placed at locations where high pressure lines are monitored so that if a break in a line occurs, the switch 310 of that particular device can be actuated to lift the suction valves of the pressurizing pump 74.

If a device of the means 22 is not to be connected to each of the connectors 260, 262 and 264, then a jumper connector 314 (FIG. 10B) must be connected thereto to maintain electrical continuity through the series circuit in which the connectors 260–264 are disposed.

The individual electrical components shown in the above-described drawings are of suitable types known to the art. Furthermore, the specific circuitry shown in the drawings forming part of the specification are not to be taken as limiting the scope of the present invention to such specific embodiment.

In the operation of the preferred embodiment, the system is connected as shown in FIGS. 1 and 2 with the previously described connectors being coupled as appropriate. The respective components are energized as appropriate.

Alignment of the lance 50 in the steam generator 2 and setting of the limit switches is done in part using the platform control box 20.

The system is preset by placing the switch 146 of the evacuation skid shown in FIG. 5 in either the local or remote position as desired. The speed at which the suction pump 60 on the evacuation skid is to operate is set via the potentiometer and control 140 (FIG. 5) or the potentiometer and control 204 (FIG. 7E) depending upon the setting of the switch 146.

On the control panel 156, the mode selector switch 158 is set in the appropriate position for the desired mode of operation. The time periods for the jetting and flushing cycles are set by appropriately manipulating the jetting time control knob 164 and the flushing time control knob 166, respectively. The direction-of-movement switch 176 is placed in the appropriate setting. The valves of the valve control means 10 which are to be used are selected by appropriate positioning of the switches **186*a–d* also contained on the control panel 156**.

To preset the motor controller means 18, the indexer 290 is preset as known to the art.

Once the system has been aligned and preset, control of the cleaning process can commence. If the automatic mode has been selected via the switch 158, the suction pump 60 is actuated via the run switch 200 contained on the control panel 156. Automatic control of the injection of fluid into the steam generator 2 and the movement of the lance 50 is initiated by actuating either the start jet switch 168 or the start flush switch 170 depending upon which cycle is to be performed first. Operation proceeds automatically with the timing means shown in FIG. 7A periodically switching the control signals between the selected jet valve and flush valve of the valve manifold means 10.

Automatic operation continues until the lance 50 has been moved to one of its limits of travel (or until the mode selector switch 158 has been switched to the manual position or the control system has been de-energized). When a limit of travel is reached, the particular limit switch which is engaged provides the limit signal (i.e., the neutral potential resulting from the inhibiting of, or switching from, the non-neutral potential in the preferred embodiment) to the motor controller means 18 which in turn provides the timing means control signal (which is the neutral signal from the engaged limit switch connected to the conductor means 232 via the conductor means 274 in the preferred embodiment) to the relay 234 shown in FIG. 7A. When this preferred embodiment neutral signal is received by the relay 234, the relay 234 is deactivated which in turn deactivates the timing means so that no further jetting, flushing or indexing occurs. However, the timing means control signal (i.e., the neutral signal in the preferred embodiment) provided by the motor controller means 18 can be overridden (i.e., a non-neutral signal can be applied in the preferred embodiment) by proper actuation of the switch 180 shown in FIGS. 6 and 7B.

During the automatic control of the cleaning operation, pressurized fluid will be continuously applied by the pump 74 unless the suction valve control circuit directs otherwise. In the automatic mode the suction valve control means will lift the suction valves of the pump 74 if the switch 194 on the control panel 156 is actuated; however, no such suction valve lifting will occur if the switch 196 of the control panel 156 is actuated because the switch 196 is operational only when the system is in the manual mode. The suction valves will also be lifted if a remote kill signal is provided from one or more of the devices of the pressure kill controller means 22. The suction valves will also be lifted if the valve logic position circuit means 250 detects that all the manifold valves are closed or it detects that more than one of the valves is open at any one time. The suction valves will also be lifted if power is lost.

If the manual mode of operation has been selected by the proper placement of the switch 158, the operation commences by actuating the suction pump via the switch 200. The jet or flush cycle is then selected by appropriate manipulation of the switch 188. Whenever the flush cycle has been selected by means of the switch 188, the lance 50 can be manually indexed by suitable actuation of the manual index switch 181, which switch 181 only functions during the flush cycle as determined by the setting of the switch 188. In the manual mode the suction valves of the pump 74 are lifted if the switch 194 is actuated, or if the switch 196 is actuated, or if one of the remote pressure kill devices 22 is actuated, or if the valve logic circuit means 250 detects that all of the valves of the manifold valve means 10 are closed, or if power is lost.

In either the automatic mode of operation or the manual mode of operation, the number of times the lance 50 has been indexed or incremented is displayed in the counter 184. The pressure provided to the valve manifold means 10 by the pump 74 is displayed played in the pressure indicator 210. The time of day is displayed by means of the clock 212.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A system for controlling an apparatus for cleaning a steam generator, having an outlet, of material which has become deposited among a group of tubes contained within said steam generator above a tube sheet thereof, which apparatus includes an advance mechanism for moving a jetting outlet within said steam generator, a flushing outlet, and fluid source means for providing a fluid under pressure to either said jetting outlet or said flushing outlet, said system comprising:

valve manifold means for communicating at different times siad fluid from said fluid source means with a selectable one of said jetting outlet or said flushing outlet for alternately creating, only at non-coincident times, a jetting fluid flow out of said jetting outlet directed among said tubes to separate the deposited material from among said tubes and a flushing fluid flow out of said flushing outlet directed along said tube sheet around said group of tubes to flush the separated material out said outlet of said steam generator;

advance mechanism control means for controlling the distance said advance mechanism moves said jetting outlet; and control means for controlling said valve manifold means and said advance mechanism control means, said control means including timing means for providing a first signal to said valve manifold means to cause said valve manifold means to communicate said fluid with said jetting outlet when said jetting outlet is stationary so that at least a portion of the material is separated from among said tubes at a first time and for providing, after the termination of said first signal, a second signal to said valve manifold means and said advance mechanism control means to cause said valve manifold means to communicate said fluid with said flushing outlet and to activate said advance mechanism control means to move said advance mechanism so that the portion of the material separated during said first time is washed toward said outlet of said steam generator at a second time which is different from said first time and so that said jetting outlet is incrementally moved only when no fluid is flowing through said jetting outlet.

2. A system as defined in claim 1, wherein:

said apparatus further comprises limit means, associated with said advance mechanism, for providing a limit signal;

said advance mechanism control means includes means, responsive to said limit signal, for providing a timing means control signal; and said control means further includes means, responsive to said timing means control signal, for preventing said timing means from providing said first and second signals.

3. A system as defined in claim 2, further comprising manual means for manually controlling said advance mechanism control means from a location spaced from said control means.

4. A system for controlling an apparatus for cleaning a steam generator, which apparatus includes an advance mechanism for moving a jetting outlet within said steam generator, a flushing outlet, and fluid source means for providing a fluid under pressure to either said jetting outlet or said flushing outlet, said system comprising:

valve manifold means for communicating at different times said fluid from said fluid source means with a selectable one of said jetting outlet or said flushing outlet, said valve manifold means including:

at least one jet valve movable between an open position and a closed position; and at least one flush valve movable between an open position and a closed position;

advance mechanism control means for controlling the distance said advance mechanism moves said jetting outlet; and control means for controlling said valve manifold means and said advance mechanism control means, said control means including:

timing means for providing a first signal to said valve manifold means for moving at least one said jet valve to said open position thereof to communicate said fluid with said jetting outlet at a first time and for providing a second signal both to said valve manifold means, for moving at least one said flush valve to said open position thereof to communicate said fluid with said flushing outlet at a second time which is different from said first time, and to said advance mechanism control means, for activating said advance mechanism control means to move said advance mechanism during said second time;

monitor means for monitoring the open and closed positions of said jet and flush valves of said valve manifold means, said monitor means including logic means for generating an inhibit signal indicating a condition wherein at least one jet valve and at least one flush valve could be simultaneously open; and fluid source control means, responsive to said monitor means, for causing said fluid source means to relieve said pressure on said fluid when said logic means generates said inhibit signal so that said fluid cannot flow through any jet valve or flush valve when at least one of each type of said valves could be simultaneously open.

5. A system as defined in claim 4, further comprising means for controlling said fluid source control means from a location spaced from said control means and without regard to the state of said valve manifold means.

6. A system for controlling an apparatus for cleaning a steam generator, having an outlet, of material which has become deposited among a group of tubes contained within said steam generator above a tube sheet thereof, which apparatus includes an advance mechanism for moving a jetting outlet within said steam generator, a flushing outlet, and fluid source means for providing a fluid under pressure to either said jetting outlet or said flushing outlet, said system comprising:

valve manifold means for communicating at different times said fluid from said fluid source means with a selectable one of said jetting outlet or said flushing outlet for alternately creating, at non-coincident times, a jetting fluid flow out of said jetting outlet directed among said tubes to separate the deposited material from among said tubes and a flushing fluid flow out of said flushing outlet directed along said tube sheet around said group of tubes to flush the separated material out said outlet of said steam generator, said valve manifold means including:

at least one jet valve movable between an open position and a closed position; and at least one flush valve movable between an open position and a closed position;

advance mechanism control means for controlling the distance said advance mechanism moves said jetting outlet; and control means for controlling said valve manifold means and said advance mechanism control means, said control means including:

timing means for providing a first signal to said valve manifold means for moving at least one said jet valve to said open position thereof to communicate said fluid with said jetting outlet when said jetting outlet is stationary so that at least a portion of the material is separated from among said tubes at a first time and for providing, after the termination of said first signal, a second signal to said valve manifold means and said advance mechanism control means for moving at least one said flush valve to said open position thereof to communicate said fluid with said flushing outlet and for activating said advance mechanism control means to move said advance mechanism so that the portion of the material separated during said first time is washed toward said outlet of said steam generator at a second time which is different from said first time and so that said jetting outlet is incrementally moved only when no fluid is flowing through said jetting outlet;

monitor means for monitoring the open and closed positions of said jet and flush valves of said valve manifold means, said monitor means including logic means for generating an inhibit signal indicating a condition wherein at least one jet valve and at least one flush valve could be simultaneously open; and fluid source control means, responsive to said monitor means, for causing said fluid source means to relieve said pressure on said fluid when said logic means generates said inhibit signal so that said fluid cannot flow through any jet valve or flush valve when at least one of each type of said valves could be simultaneously open.

7. A system for controlling an apparatus for cleaning a steam generator, which apparatus includes sludge lance, stepping motor means for incrementally moving said sludge lance in said steam generator, a flushing fluid outlet, and pump means, having suction valves, for providing a pressurized fluid, said system comprising:

valve manifold means for communicating at different times said fluid with a selectable one of said sludge lance or said flushing fluid outlet, said valve manifold means including a plurality of valves, each of said valves having an open position and a closed position;

motor control means for controlling the length of an increment said stepping motor means moves said sludge lance; and control means for controlling said valve manifold means, said motor control means, and said pump means, said control means including:

timing means for placing a first one of said valves in its open position so that said fluid is communicated with said sludge lance at a first time and for placing a second one of said valves in its open position so that said fluid is communicated with said flushing outlet at a second time which is different from said first time and for actuating, at said second time, said motor control means so that said stepping motor means moves said sludge lance an increment;

monitor means for monitoring whether said first one of said valves is in its open or closed position and whether said second one of said valves is in its open or closed position; and first relay means, responsive to said monitor means, for opening said suction valves of said pump means when both said first and second ones of said valves are in their closed positions so that said fluid is thereby not pressurized by said pump means to disable flow to said valve manifold means.

8. A system as defined in claim 7, wherein:

said motor control means includes limit detection means for detecting when said sludge lance has moved to a predetermined limit of travel; and said control means includes second relay means, responsive to said limit detection means, for preventing said timing means from placing said first and second ones of said valves in their open positions.

9. A system for controlling an apparatus for cleaning a steam generator, which apparatus includes a sludge lance, stepping motor means for incrementally moving said sludge lance in said steam generator, a flushing fluid outlet, and pump means, having suction valves, for providing a pressurized fluid, said system comprising:

valve manifold means for communicating said fluid with said sludge lance and said flushing fluid outlet, said valve manifold means including a plurality of valves, each of said valves having an open position and a closed position;

motor control means for controlling the length of an increment said stepping motor means moves said sludge lance, said motor control means including limit detection means for detecting when said sludge lance has moved to a predetermined limit of travel; and control means for controlling said valve manifold means, said motor control means, and said pump means, said control means including:

timing means for placing a first one of said valves in its open position so that said fluid is communicated with said sludge lance at a first time and for placing a second one of said valves in its open position so that said fluid is communicated with said flushing outlet at a second time and for actuating, at said second time, said motor control means so that said stepping motor means moves said sludge lance an increment;

monitor means for monitoring whether said first one of said valves is in its open or closed position and whether said second one of said valves is in its open or closed position;

first relay means, responsive to said monitor means, for opening said suction valves of said pump means when both said first and second ones of said valves are in their closed positions;

second relay means, responsive to said limit detection means, for preventing said timing means from placing said first and second ones of said valves in their open positions; and override means for overriding said limit detection means so that said second relay means does not prevent said timing means from placing said first and second ones of said valves in their open positions.

* * * * *

UNITED STATES PATENT AND TRADEMARK OFFICE

CERTIFICATE OF CORRECTION

PATENT NO. : 4,527,515

DATED : July 9, 1985

INVENTOR(S) : Lawrence R. Hester, II

It is certified that error appears in the above-identified patent and that said Letters Patent is hereby corrected as shown below:

In column 2, line 65, delete the word [outletand] and insert therefor --outlet and--.
In column 3, line 6, delete the word [signa] and insert therefor --signal--.
In column 3, line 19, delete the word [systemalso] and insert therefor --system also--.

In column 14, line 38, delete the number [24] and insert therefor -244-.
In column 17, line 21, delete the word [played].
In column 17, line 44, delete the word [siad] and insert therefor --said--.
In column 20, line 7, following the word "includes" insert the word --a--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*